United States Patent [19]

Lewis

[11] 3,975,865

[45] Aug. 24, 1976

[54] FIBER OPTIC GRINDING AND POLISHING TOOL

[75] Inventor: Adolph L. Lewis, La Mesa, Calif.

[73] Assignee: The United States of America as represented by the Secretary of the Navy, Washington, D.C.

[22] Filed: May 27, 1975

[21] Appl. No.: 580,856

[52] U.S. Cl. ..... 51/170 T; 51/219 R
[51] Int. Cl.[2] ..... B24B 23/00
[58] Field of Search ..... 51/170 T, 219 R

[56] References Cited

UNITED STATES PATENTS

| | | | |
|---|---|---|---|
| 3,299,579 | 1/1967 | Jacobson | 51/209 R |
| 3,698,140 | 10/1972 | Steadman | 51/219 R |
| 3,742,652 | 7/1973 | Enders | 51/219 R |
| 3,803,771 | 4/1974 | Bunn | 51/170 T |

*Primary Examiner*—James L. Jones, Jr.
*Attorney, Agent, or Firm*—R. S. Sciascia; G. J. Rubens; T. M. Phillips

[57] ABSTRACT

A hand-held fiber optic grinding and polishing tool for finishing ends of fiber optic cables includes a motor mounted in a hand-held body member for rotatably driving a disc. The disc has a circular planar surface with multiple discrete concentric sections, each section having a different degree of abrasive surface for grinding and polishing. A fiber optic cable guide is supported on the hand-held body member and has multiple ports to receive fiber optic cable ends, each of the ports being aligned with one of the concentric abrasive sections and configured to position the fiber optic cable ends for a predetermined amount of grinding and polishing. In a preferred embodiment the fiber optic cable guide is removable to permit selective replacement by alternate guide members accommodating different sizes of fiber optic cable ends.

4 Claims, 5 Drawing Figures

FIBER OPTIC GRINDING AND POLISHING TOOL

BACKGROUND OF THE INVENTION

The use of fiber optic cables to provide an optical path in optical systems has been greatly extended and enlarged in recent development of optical technology. In such optical systems it is frequently necessary to provide terminals, couplers, and connections with respect to the optical path provided by such fiber optic cables. In order to give effect to such required terminals, couplers, and connections, it is usually necessary to grind and polish the end of the fiber optic cable. Conventional type of equipment used for this purpose in the past was essentially of the type employed for lapidary procedures, usually comprising a bench-mounted, electrically driven, grinding and polishing wheel. Customarily, such bench-mounted lapidary equipment required water or other coolant because of the need for cooling due to the relatively high speed type of operation of such equipment.

Moreover, in the use of such prior art equipment to grind and polish the end of the fiber optic cable, great care had to be exercised so as not to grind off too much or too little of the fiber optic cable end.

With the recent and current development of optical systems employing fiber optic cables for communication and other systems, the installation of fiber optic cables has spread to ships, aircraft, and other vehicles. Obviously, the use of conventional bench-mounted lapidary type equipment for grinding and polishing fiber optic cable ends in restricted spaces of ships and aircraft is neither practical nor desirable. Accordingly, there is a need for a hand-held, portable, fiber optic cable grinding and polishing tool which is self-powered, small enough to be conveniently used in restricted spaces, and capable of grinding and polishing fiber optic cable ends to provide terminals, couplers, and connections in optical paths as and where desired within an optical system, particularly an optical system which has already been installed in the vessel or aircraft.

Moreover, it is highly desirable that such a fiber optic grinding and polishing tool include a means which will function to position fiber optic cable ends relative to the abrasive grinding and polishing surface so that a predetermined amount of grinding and polishing will be automatically accomplished, avoiding the problem of removing too much or too little of the fiber optic cable as was frequently the case in the use of conventional prior art equipment and techniques.

SUMMARY OF THE INVENTION

The present invention comprises a hand-held fiber optic grinding and polishing tool which includes a body member, preferably of the pistol grip type, with a motor mounted therein for rotatably driving a disc member. The disc member is characterized as having a circular planar surface with multiple, discrete, concentric sections, each such section having a different degree of abrasive surface preferably including a plurality of different degrees of grinding sections and at least one polishing section with a relatively mild abrasive polishing surface.

In a preferred embodiment of the present invention, the handle portion of the grinding and polishing tool may be hollow for receiving and supporting batteries which are connected through a manually operative electrical switch to control actuation of the motor and the driven abrasive disc member.

An important feature of the present invention is a fiber optic cable guide supported on the body member and having multiple ports dimensioned and configured to receive fiber optic cable ends. Each of the ports is aligned with one of the concentric sections of the abrasive disc and is so configured to position fiber optic cable ends for a predetermined amount of grinding and polishing as desired.

In a preferred embodiment of the present invention, the fiber optic cable guide is removably mounted on the body member to permit selective replacement by guide members which will accommodate different sizes of fiber optic cable ends to accomplish the controlled and predetermined amount of grinding and polishing for each such different size fiber optic cable end.

It will be apparent to those skilled and knowledgeable in the pertinent arts that the fiber optic grinding and polishing tool of the present invention affords the advantage of being useable in remote, constricted areas such as may be encountered in ships, vessels, and aircraft, where optical systems employing fiber optic cables are installed.

Additionally, the fiber optic cable end guide member of the present invention has multiple ports, with each such port aligned with a different abrasive section of the rotatably driven disc of the tool for providing positive control of the amount of grinding and polishing in a desirable, predetermined degree. This unique feature is a major and significant advantage in finishing fiber optic cable ends in optical systems, particularly where the repair, addition, or replacement of terminals, couplers, or junctions must be made in a pre-existing system.

Moreover the hand-held fiber optic grinding and polishing tool of the present invention is driven at slower speeds than the prior art, bench mounted lapidary type equipment so that no liquid coolant is required, which further adapts its advantageous use to remote, constricted areas.

Accordingly, it it a primary object of the present invention to provide a hand-held, self-powered, fiber optic grinding and polishing tool which is specially adaptable for use in preinstalled system for finishing fiber optic cable ends at remote and constricted areas.

An equally important object of the present invention is to provide such a grinding and polishing tool for fiber optic cable ends which incorporates a means for automatically positioning the fiber optic cable end during the process of grinding and polishing to produce a predetermined amount of grinding and polishing.

A concomitant object of the present invention is to provide for means to support a fiber optic cable end during grinding and polishing to assure a finished end surface which is absolutely flat and square to the optical path of the cable.

A further important object of the present invention is to provide such a fiber optic grinding and polishing tool which is readily adaptable to accommodate different sizes of fiber optic cable ends as desired.

Another important object of the present invention is to provide such a fiber optic grinding and polishing tool for finishing fiber optic cable ends which requires a minimum learning time for its effective and efficient use.

These and other features, objects, and advantages of the present invention will be better appreciated from an understanding of the operative principles of a preferred embodiment as described hereinafter and as illustrated in the accompanying drawings.

DESCRIPTION OF THE PREFERRED EMBODIMENTS

Figure 2:
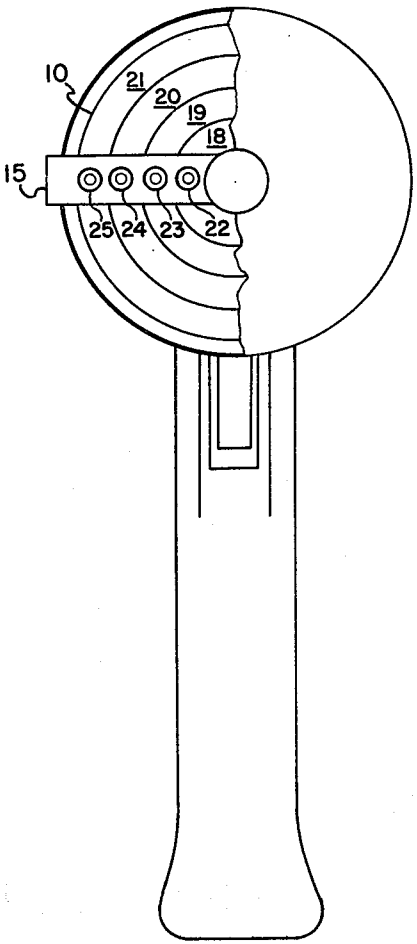
FIG. 2 is a partially cut-away end view of the fiber optic grinding and polishing tool shown in FIG. 1.
Figure 1:
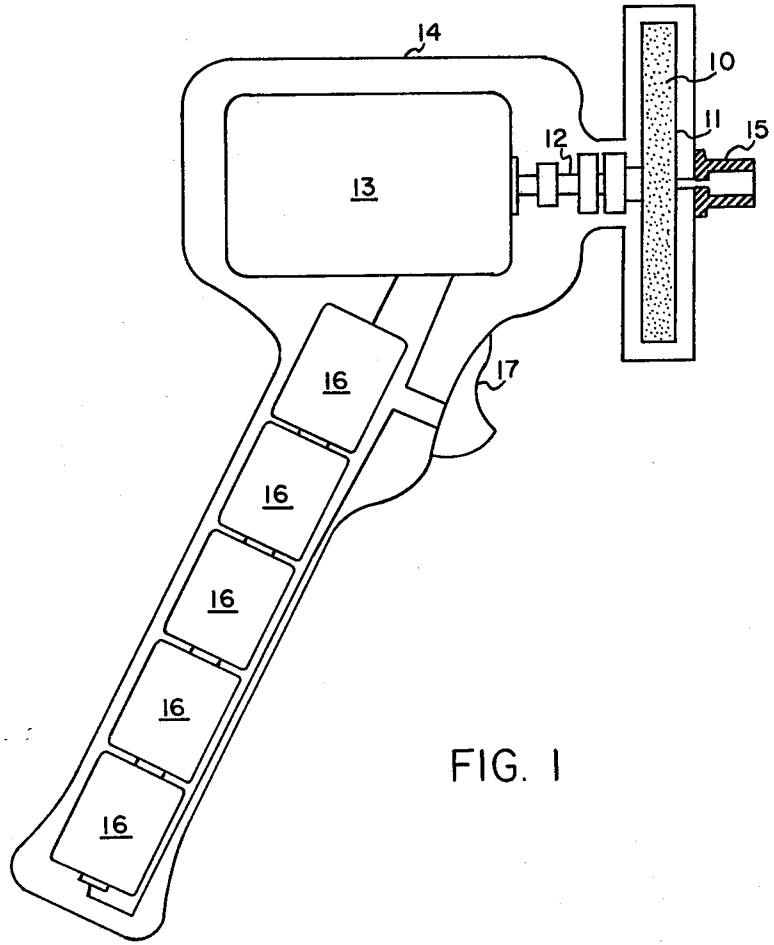
FIG. 1 is a partially cross-sectional side view of a preferred embodiment of the fiber optic polishing and grinding tool of the present invention.

FIGS. 1 and 2 illustrate a preferred embodiment of the present invention in side and end views, respectively. In FIG. 1 the hand-held fiber optic grinding and polishing tool of the present invention comprises a disc member 10 having a circular planar surface 11 and a shaft 12 which is centrally affixed to the disc member 10. A motor means 13 is mounted in a hand-held body member 14 for rotatably driving the shaft 12 and the disc member 10. A fiber optic cable guide 15 is supported on the body member 14 and is adapted to receive and supportably position fiber optic cable ends relative to the rotatably driven disc 10 to automatically give effect to a predetermined amount of grinding and polishing of the fiber optic cable end as desired.

In a preferred embodiment of the present invention the body member 14 is adapted to receive a plurality of batteries 16 which are connected through a switch 17 for selectively actuating the motor means 13 as desired in the use of the tool. FIG. 2 is an end view illustration of the embodiment of the present invention illustrated in FIG. 1 and shows more clearly an inherent feature of the present invention which provides for multiple discrete concentric sections 18, 19, 20, and 21 on the planar surface 11 of the disc 10, each having a different degree of abrasive surface and preferably including at least one grinding section and a polishing section as shown in the cut-away portion of FIG. 2.

Mounted radially with respect ot the described multiple discrete concentric sections 18, 19 20, and 21 is a fiber optic cable guide 15 supported on the body member and having multiple ports 22, 23, 24 and 25. It should be noted each of the ports 22, 23, 24, and 25 is aligned with one of the previously described multiple discrete concentric abrasive sections 18, 19, 20, and 21 to provide different degrees of abrasion for the grinding and polishing of fiber optic cable ends.

Thus, for example, the concentric section 18 may typically be a coarse abrasive, its next adjacent concentric section 19 may be a medium-coarse abrasive, and the next adjacent concentric section a relatively fine abrasive, while the outside adjacent concentric section may be a polishing surface.

Figure 3:
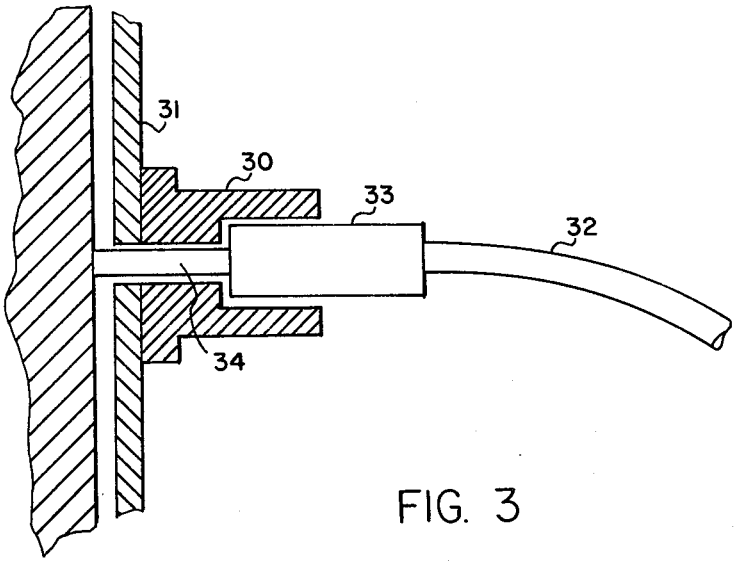
FIG. 3 is an enlarged partially cross-sectional view of a fiber optic cable guide as employed in a preferred embodiment of the present invention.

As shown in the partially cross-sectional view of FIG. 1, it should be noted that the fiber optic cable guide 15 is of a particular configuration to accept fiber optic cable ends of a specific size and is configured with a shoulder to provide an advantageous function and feature of the present invention which may be appreciated more fully from the partially cross-sectional view of FIG. 3.

In FIG. 3 the fiber optic cable guide 30 is shown supported on the body member 31 of the fiber optic cable grinding and polishing tool to receive fiber optic cable end or terminal. Typically such fiber optic cable end includes a portion of the fiber optic cable itself 32 and an end fitting 33 having a narrower portion 34 which encases the ends of the actual fiber optic filaments. It is the end of this extreme terminal portion 34 which it is desired to grind and polish with a high degree of accuracy in as short a time as possible while acomplishing grinding and polishing in a predetermined amount relative to the final desired configuration of the fiber optic end. This is accomplished through the use of the fiber optic cable guide of the present invention which includes a shoulder in each port so that when the fiber optic cable guide is inserted into each port of the fiber optic cable guide, it is supported to be ground and polished to a predetermined degree, producing the desired final length and an absolutely flat surface of the fiber optic end or terminal.

In accordance with the concept of the present invention, the shoulders of each of the several ports may have a slightly different depth so that as the guiding and polishing procedure is accomplished from the coarsest grinding, as represented by the concentric ring 18 in FIG. 2, through the several degrees of grinding provided by concentric rings 19 and 20, to the polishing concentric ring 21 of FIG. 2, a final desired length and configuration of the fiber optic end or terminal will be realized automatically without requiring any particular skill on the part of the operator nor any adjustment of the tool.

Figure 4A:
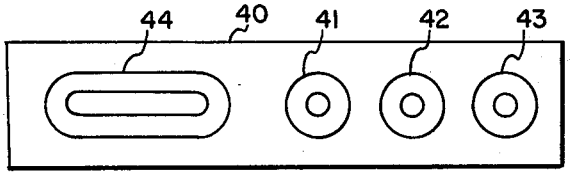
FIG. 4*a* is a top view of an alternative form of fiber optic cable guide which may be employed in the present invention.
Figure 4B:
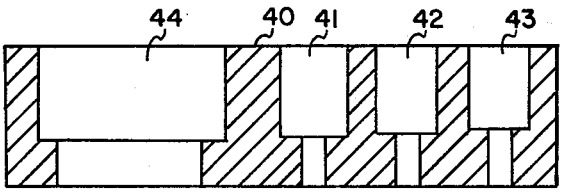
FIG. 4*b* is a cross-sectional view of the alternative form of fiber optic cable guide shown in FIG. 4*a*.

FIGS. 4*a* and 4*b* are top and cross-sectional veiws, respectively, of an alternative type of fiber optic cable guide which may be advantageously employed within the concept of the present invention. The fiber optic cable guide 40 of FIGS. 4*a* and 4*b* is preferably removably supported on the body member of the hand-held fiber optic grinding and polishing tool as illustrated in FIGS. 1 and 2, so that it may be selectively replaced by guide members having ports therein for accommodating different sizes of fibers optic ends.

The fiber optic cable guide 40 of FIGS. 4*a* and 4*b* consists of a plurality of ports 41, 42, and 43 essentially of the same type and general configuration as the circular ports shown in the illustrative drawings of FIGS. 1, 2, and 3. However, the fiber optic cable guide illustrated in FIGS. 4*a* and 4*b* also includes a slotted port 44 which is adapted to receive a fiber optic cable end for slidably supporting the fiber optic cable end during the final polishing procedure, which includes the step of the operator slidably moving the cable end back and forth in the slotted port while the polishing is being accomplished by the polishing section of the grinding and polishing disc member of the hand-held fiber optic grinding and polishing tool.

In the preferred emobdiment of the present invention, the plurality of ports 41, 42, 43 and 44 for receiving and supporting the fiber optic cable ends during the grinding and polishing procedure are graduated in depth from the outermost port 43 to the innermost port 44 as shown in FIG. 4*b*. Thus, in accordance with the concept of the present invention an initial amount may be ground from the fiber optic cable end to produce an initial predetermined desired length as determined by the depth of port 43, while succeeding steps in slightly deeper ports 42 and 41 relative to the rotatably driven grinding and polishing disc member will produce gradual grinding during the course of the multiple successive, steps to produce a flat configuration of fiber optic cable end of a desired length as predetermined by the graduated depth of each successive port leading to the final step of polishing in port 44 which provides the desired finished length of the polished fiber optic cable end.

Those skilled and knowledgeable in the pertinent arts will readily appreciate that the concept of the present invention provides a hand-held fiber optic grinding and polishing tool which is light weight, self-powered, and readily adaptable for use in confined, remote, and difficult to reach areas of a ship, aircraft, or vehicle, particularly where optical systems have been pre-installed.

Thus, the presently hand-held fiber optic grinding and polishing tool of the present invention affords a highly useful, most effective, and desirable tool for completing the installation, replacement or repair of fiber optic cable ends in such confined areas with an advantageously high degree of accuracy as to the desired length of the fiber optic cable end and the flatness of its surface.

Obviously many modifications and variations of the present invention are possible in the light of the above teachings. It is therefore to be understood that within the scope of the appended claims the invention may be practiced otherwise than as specifically described.

What is claimed is:

1. A hand-held fiber optics grinding and polishing tool comprising:

a disc member having a circular planar surface with multiple discrete concentric sections, each section having a different degree of abrasive surface including at least one grinding section and a polishing section;

a shaft centrally affixed to said disc member;

motor means mounted in a hand-held body member for rotatably driving said shaft and said disc member; and a selectively replaceable fiber optic cable guide removably supported on said body member and having multiple ports to receive fiber optic cable ends of known cross-sectional size, said ports being aligned with respective concentric sections and having shoulder portions sequentially graduated in depth relative to said concentric sections to support said fiber optic cable ends at predetermined positional depths for producing sequentially progressive amounts of grinding and polishing and the desired finished length of polished fiber optic cable end.

2. A hand-held fiber optic grinding and polishing tool as claimed in claim 1 wherein said body member is adapted to receive batteries connectable to said motor means.

3. A hand-held fiber optic grinding and polishing tool as claimed in claim 2 including manually operable switch means mounted on said body member and connected between said motor means and said batteries for selectively actuating said motor means.

4. A hand-held fiber optic grinding and polishing tool as claimed in claim 1 wherein said fiber optic cable guide includes a slotted port aligned with said polishing section.

* * * * *